United States Patent [19]

Pickle

[11] Patent Number: 5,016,382

[45] Date of Patent: May 21, 1991

[54] REMOVABLE FRONT SIGHT FOR HANDGUNS

[75] Inventor: Linwood A. Pickle, South Hadley, Mass.

[73] Assignee: Smith & Wesson Corp., Springfield, Mass.

[21] Appl. No.: 486,882

[22] Filed: Mar. 1, 1990

[51] Int. Cl.[5] ..... F41G 1/02

[52] U.S. Cl. ..... 42/100; 33/233

[58] Field of Search ..... 42/100, 101; 33/233, 33/250, 241, 242, 243

[56] References Cited

U.S. PATENT DOCUMENTS

| | | | |
|---|---|---|---|
| 2,942,346 | 6/1960 | Staubach | 33/250 |
| 3,205,579 | 9/1965 | Plisk | 33/250 |
| 4,015,354 | 4/1977 | Brouthers | 42/100 |
| 4,742,635 | 5/1988 | Ruger et al. | 42/100 |

FOREIGN PATENT DOCUMENTS

| | | | |
|---|---|---|---|
| 0085416 | 4/1955 | Norway | 42/100 |

OTHER PUBLICATIONS

*American Rifleman,* "Ruger Redhawk", Feb. 1984.

*Primary Examiner*—Michael J. Carone

*Attorney, Agent, or Firm*—Chapin, Neal & Dempsey

[57] ABSTRACT

Removable front sight for the barrel of a firearm has an upper blade portion and a lower keel portion. The keel portion is undercut and adapted to fit into an upwardly opening recess provided in the upper surface of the gun barrel and adjacent the front end thereof. A cylindrical hole extends longitudinally from the muzzle end of the barrel, communicates with the recess, and terminates rearwardly thereof to provide a housing for a combination spring and detent disposed therein. The detent is releasably urged forwardly by the spring to engage the inner end of the keel. A cross-pin is fitted across the recess to engage the forward end of the keel and to prevent removal of the spring and detent from the cylindrical hole. The spring is rearwadly compressible sufficiently to enable insertion and removal of the keel from the recess from between the detent and cross-pin.

3 Claims, 1 Drawing Sheet

REMOVABLE FRONT SIGHT FOR HANDGUNS

BACKGROUND OF THE INVENTION

This invention relates to removable gunsights such as used on handguns and, in particular, to such gunsights as may be removed from and replaced on the barrel of the gun without the use of tools and which require no separate fasteners.

While U.S. Pat. No. 4,015,354 discloses a front gunsight which is removable from the barrel of a firearm, that sight requires the use of an allen head type wrench to remove and replace the setscrew which fastens the sight in place on the barrel.

It is the principal object of the present invention to provide a gunsight removably fitted onto the front end of the barrel of a gun which, although securely fastened in place on the gun barrel, is readily removable without the use of tools and has no separable fasteners.

The above and other objects and advantages of this invention will be more readily apparent from the following description read in conjunction with the accompanying drawings in which.

Figure 1:
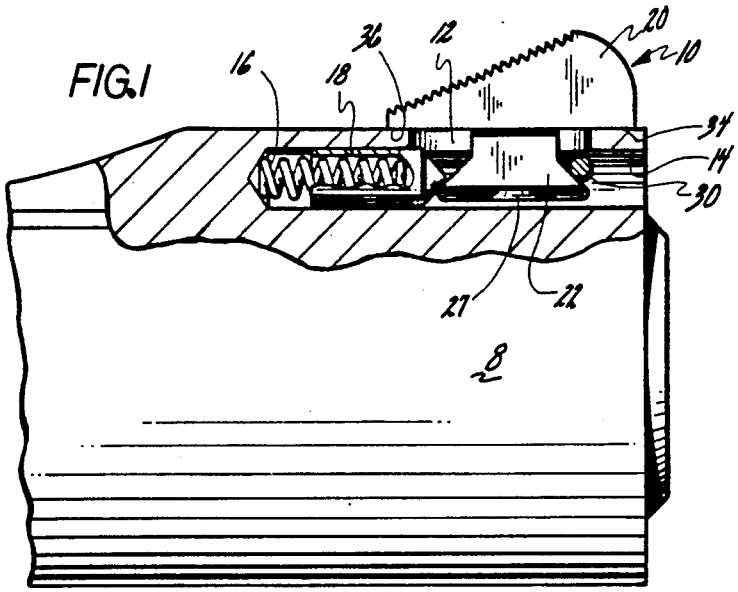
FIG. 1 is an elevational view, partly in section, of a removable front gunsight of the type embodying this invention as fitted onto the barrel of a handgun.

Referring in detail to the drawing, in FIG. 1 is shown a removable gunsight 10 of the type embodying this invention disposed on a gun barrel 8. The sight, shown generally at 10, disposed adjacent the muzzle end of the barrel, is fitted into a recess 12 machined into the upper surface of the barrel. A cylindrical hole or bore 14 extends longitudinally from the muzzle end of the barrel 8, communicates with the recess 12 and extends rearwardly thereof a sufficient distance to accommodate a combination spring 16 and detent or tubular pin 18.

Figure 3:
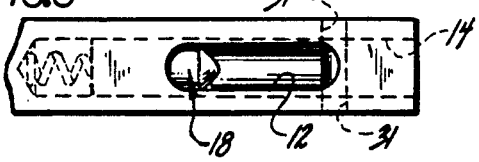
FIG. 3 is a plan view of the barrel of the gun shown in FIG. 1 with the sight removed.
Figure 4:
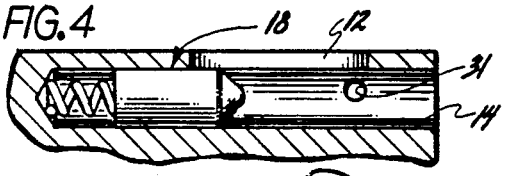
FIG. 4 is an elevational view of the barrel prior to mounting the gunsight thereon.

The sight 10 is of integral construction and includes an upper blade or sail portion 20 of any desirable configuration and a lower support or keel portion 22 fitted into an elongated slot or recess 12. The keel has a generally rectangular waist portion 23 (FIG. 6) and an outwardly flared skirt defined by oppositely inclined edges 24 and 26. The lower edge of the keel is chamfered, beveled or radiused at 27 to provide for clearance with the interior wall of bore 14. Means is provided for engaging the forward edge 26 of the keel 22 to assist in retaining the sight in place in recess 12. The retaining means may consist of the forward edge of recess 12, a fixed projection or a removable pin 30, either tapered or cylindrical. In the preferred embodiment, a longitudinally tapered pin 30 is press-fitted into a correspondingly tapered hole 31 (FIG. 3) drilled transversely across the barrel at the forward end of the recess 12 and serves to secure the front end of the keel 22 in place within the recess 12. The pin 30 is installed after the spring and detent have been fitted into the bore and thus also prevents inadvertent removal of spring 16 and detent 18 from bore 14.

Figure 5:
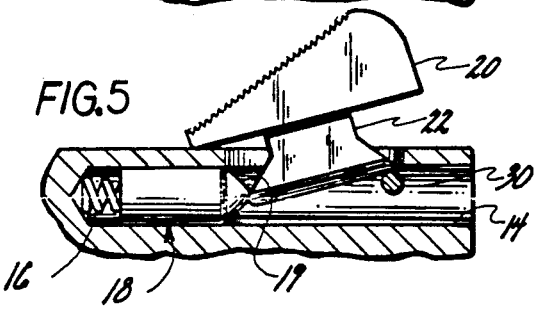
FIGS. 5 and 6 are elevational views showing the gunsight embodying this invention being fitted onto the barrel of the handgun.
Figure 6:
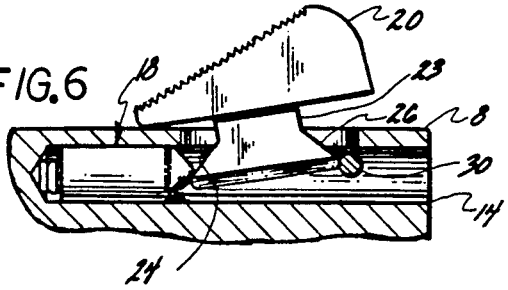
Figure 2:
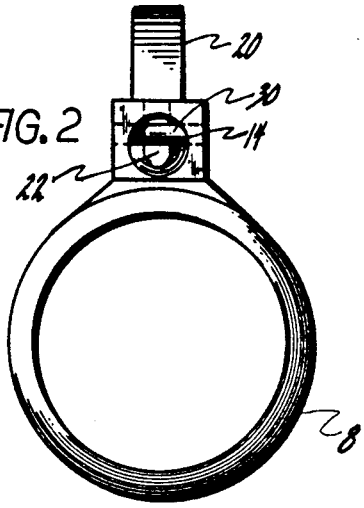
FIG. 2 is a front end view of the sight shown in FIG. 1.

The detent or pin 18 has a conical tip 19 at its outer end and its inner end is hollow or tubular to receive therein the coil spring 16. When fitted into the inner end of bore 14, the spring 16 urges the pin forwardly so that the inner, or conical, end of the pin 18 extends a substantial distance into the recess 12 for engagement with the tapered rear end 24 of the keel 22. The undersurface of the blade portion of the sight, shown generally at 34 and 36, engage the upper surface of the barrel when the sight is fitted into the recess 12 and bore 14. The width of keel 22 is selected to fit into slot 12 but with small tolerance so that the sight will not shift or wobble laterally. The major dimension, or length, of the keel is somewhat less than the longitudinal dimension of the slot 12 so that the keel can be readily fitted into the slot by first tilting it, as shown in FIG. 5, and then moving it rearwardly against pin 18 to compress spring 16. The front end of the keel may then be rotated downwardly and thereby interfitted between the detent pin 18 and the cross-pin 30. This installation sequence is depicted in FIGS. 5 and 6 of the drawings. When fitted between the detent pin and the cross-pin, the sight 10 will remain fixed in place despite the inertial forces caused by recoil of the gun since any resultant forward movement is prevented by the fixed cross-pin 30. To remove the sight for repair or replacement, however, it is only necessary to grip the blade portion of the sight and manually moved rearwardly by compressing spring 16 until the sight 10 can then be removed from the recess 12 by tilting its forward-end upwardly clear of pin 30, as best illustrated in FIG. 6 of the drawings. Thus, although the sight 10 embodying this invention is readily removable, its positional stability is unaffected by the force of recoil since removal of the sight from the barrel of the gun is accomplished only by rearward movement of the sight against the spring detent 18.

Having thus described my invention, what is claimed is:

1. Removable front sight in combination with retaining means for the barrel of a firearm having an upwardly opening recess disposed adjacent the muzzle end of the barrel and a hole extending longitudinally from the front surface of the barrel, communicating with the recess and extending rearwardly thereof, the combination comprising a spring and detent pin disposed in the inner end of the hole and a cross-pin disposed across the forward end of the recess, the cross-pin and detent pin being longitudinally spaced apart a predetermined distance and providing paid retaining means, a discrete front sight having an outer blade portion and an undercut keel portion adapted for removably fitting into the recess with the blade contacting upper surfaces of the barrel, the keel portion of the sight including oppositely inclined front and rear edge portions and a lower edge portion of greater length than said predetermined distance so that the keel portion of the sight is removably retained in the barrel recess by the inclined rear edge of the keel engaging the detent pin and the inclined front edge engaging the retaining means and being removable by compressing the spring by rearward movement of the keel against the detent pin.

2. Removable front sight for the barrel of a firearm, as set forth in claim 1, in which the detent pin includes a conical tip and in which the cross-pin is press-fitted into a correspondingly shaped hole.

3. Removable front sight for the barrel of a firearm, as set forth in claim 2, in which said cross-pin is longitudinally tapered and is press-fitted into a correspondingly tapered hole.

* * * * *